US012194522B2

(12) United States Patent
Wusatowska-Sarnek et al.

(10) Patent No.: US 12,194,522 B2
(45) **Date of Patent: *Jan. 14, 2025**

(54) SYSTEMS AND METHODS FOR IMPROVING BACKWARD FLOW FORMING OF SHAFTS

(71) Applicant: Raytheon Technologies Corporation, Farmington, CT (US)

(72) Inventors: Agnieszka Wusatowska-Sarnek, Mansfield Ctr, CT (US); John Palitsch, Vernon, CT (US)

(73) Assignee: RTX CORPORATION, Farmington, CT (US)

( * ) Notice: Subject to any disclaimer, the term of this patent is extended or adjusted under 35 U.S.C. 154(b) by 391 days.

This patent is subject to a terminal disclaimer.

(21) Appl. No.: 17/513,720

(22) Filed: Oct. 28, 2021

(65) Prior Publication Data

US 2022/0048089 A1 Feb. 17, 2022

Related U.S. Application Data

(62) Division of application No. 15/934,500, filed on Mar. 23, 2018, now Pat. No. 11,185,905.

(51) Int. Cl.
*B21D 22/16* (2006.01)
*B21D 51/10* (2006.01)
(Continued)

(52) U.S. Cl.
CPC ..... *B21D 22/16* (2013.01); *B21D 51/10* (2013.01); *B21D 51/16* (2013.01); *C21D 1/18* (2013.01); *C21D 9/28* (2013.01)

(58) Field of Classification Search
CPC ..... B21D 22/14; B21D 22/16; B21D 22/18; B21D 51/10; B21C 1/16; B21C 1/22; B21C 1/26
See application file for complete search history.

(56) References Cited

U.S. PATENT DOCUMENTS 2,942,337 A * 6/1960 Wehmeier ..... B23P 15/24 29/402.21
7,762,114 B2 * 7/2010 Abney ..... C23C 14/564 72/85
(Continued)

FOREIGN PATENT DOCUMENTS

DE 102006001064 7/2007
DE 102006001064 A1 * 7/2007 ..... B21C 1/26
(Continued)

OTHER PUBLICATIONS

Ceylan Kubilay, "Flow Forming of Aeroengine Materials", A thesis submitted to the University of Manchester for the Degree of Doctor of Philosophy in the Faculty of Engineering and Physical Sciences, dated 2014, pp. 1-224.
(Continued)

*Primary Examiner* — Debra M Sullivan
(74) *Attorney, Agent, or Firm* — SNELL & WILMER L.L.P.

(57) ABSTRACT

An apparatus for backward flow forming a material may comprise a mandrel having a headstock at a proximate end of the mandrel, the mandrel configured to rotate about an axis, a plurality of rollers disposed radially outward of the mandrel configured to exert force on the material to form a work piece at a plastic deformation zone, wherein the work piece flows from the plastic deformation zone between the plurality of rollers and the mandrel toward a distal end of the mandrel, and a catcher, coaxial to the mandrel, and removably coupled to the work piece at a traveling end of the work piece.

6 Claims, 6 Drawing Sheets

(51) Int. Cl.

| | |
|---|---|
| *B21D 51/16* | (2006.01) |
| *C21D 1/18* | (2006.01) |
| *C21D 9/28* | (2006.01) |

(56) References Cited

U.S. PATENT DOCUMENTS

| | | | | |
|---|---|---|---|---|
| 9,291,057 | B2 | 3/2016 | Benjamin et al. | |
| 11,185,905 | B2 * | 11/2021 | Wusatowska-Sarnek | B21D 51/10 |
| 2007/0059460 | A1 | 3/2007 | Abney et al. | |
| 2010/0236122 | A1 | 9/2010 | Fonte | |
| 2015/0083284 | A1 | 3/2015 | Rawson et al. | |
| 2016/0033059 | A1 | 2/2016 | Fonte | |

FOREIGN PATENT DOCUMENTS

| | | |
|---|---|---|
| DE | 102015109433 | 12/2016 |
| FR | 2190243 | 1/1974 |
| NL | 7302082 | 4/1974 |

OTHER PUBLICATIONS

European Patent Office, European Office Action dated Jun. 22, 2020 in Application No. 19164061.4.

European Patent Office, European Search Report dated Jul. 4, 2019 in Application No. 19164061.4.

USPTO, Notice of Allowance, dated Aug. 4, 2021 in U.S. Appl. No. 15/934,500.

USPTO, Non-Final Office Action, dated May 11, 2021 in U.S. Appl. No. 15/934,500.

USPTO, Requirement for Restriction/Election, dated Aug. 6, 2020 in U.S. Appl. No. 15/934,500.

USPTO, First Action Interview Office Action, dated Mar. 2, 2021 in U.S. Appl. No. 15/934,500.

USPTO, Pre-Interview First Office Action, dated Nov. 25, 2020 in U.S. Appl. No. 15/934,500.

* cited by examiner

SYSTEMS AND METHODS FOR IMPROVING BACKWARD FLOW FORMING OF SHAFTS

CROSS-REFERENCE TO RELATED APPLICATIONS

This application is a divisional of, and claims priority to, and the benefit of Non-Provisional application Ser. No. 15/934,500, entitled "SYSTEMS AND METHODS FOR IMPROVING BACKWARD FLOW FORMING OF SHAFTS," filed on Mar. 23, 2018, which is hereby incorporated by reference in its entirety for all purposes.

FIELD

The present disclosure relates to flow forming of hollow shafts and more particularly to backward flow forming of hollow shafts.

BACKGROUND

Flow forming technology is a metal forming technique whereby a hollow metal blank or preform is mounted on a rotating mandrel and the material of the preform may be made to flow (plastic deformation) axially, with respect to the mandrel, under pressure of one or more rollers. In this regard, the interior diameter of the work piece remains constant with respect to the diameter of the mandrel and the outer diameter of the work piece may be reduced.

SUMMARY

In various embodiments, an apparatus for backward flow forming a material is provided. The apparatus may comprise a mandrel having a headstock at a proximate end of the mandrel, the mandrel configured to rotate about an axis, a plurality of rollers disposed radially outward of the mandrel configured to exert force on the material to form a work piece at a plastic deformation zone, wherein the work piece flows from the plastic deformation zone between the plurality of rollers and the mandrel toward a distal end of the mandrel, and a catcher, coaxial to the mandrel, and removably coupled to the work piece at a traveling end of the work piece.

In various embodiments, the traveling end further comprises a coupling feature. In various embodiments, the plurality of rollers are configured to travel from the distal end of the mandrel toward the headstock. In various embodiments, the catcher is configured to travel with the traveling end of the work piece. In various embodiments, the catcher exerts a tension in the work piece. In various embodiments, the catcher is configured to deflect the traveling end of the work piece with respect to the axis of the mandrel by oscillating with respect to the axis of the mandrel. In various embodiments, the deflection of the traveling end with respect to the axis of the mandrel is 5° to 15°. In various embodiments, shear banding is formed within the material at the plastic deformation zone in response to the deflection of the traveling end. In various embodiments, the catcher comprises one of a grab or a clamp. In various embodiments, the mandrel comprises a complex geometry having curves, multi-radial curves, or steps. In various embodiments, shear banding is formed within the material at the plastic deformation zone in response to the deflection of the roller. In various embodiments, the deflection of the roller with respect to the axis of the mandrel is 5° to 15°.

In various embodiments, a method for improving backward flow forming of a material is provided. The method may comprise mounting the material in an apparatus for backward flow forming and applying a load to a plurality of rollers forming a plastic deformation zone in the material between the plurality of rollers and a mandrel, advancing the plurality of rollers toward a headstock at a proximate end of the mandrel, wherein a work piece flows from the plastic deformation zone between the plurality of rollers and the mandrel toward a distal end of the mandrel, and coupling the work piece to a catcher at a traveling end of the work piece.

In various embodiments, the method may also comprise machining a coupling feature in the work piece proximate the traveling end of the work piece. In various embodiments, the method may also comprise applying a tension, defined between the catcher and the plastic deformation zone, at the traveling end of the work piece. In various embodiments, the coupling comprises clamping the work piece to the catcher. In various embodiments, the method may also comprise deflecting the traveling end of the work piece with respect to an axis of the mandrel. In various embodiments, the deflection with respect to the axis of the mandrel is 5° to 15°. In various embodiments, the method may also comprise forming shear banding within the material at the plastic deformation zone in response to the deflection.

In various embodiments a control system for backward flow forming of shafts is provided. The system may comprise a first sensor in electronic communication with a controller, the first sensor configured to measure at least one of a tension parameter, a deflection parameter, a catcher parameter, or an apparatus parameter, a catcher drive system in electronic communication with the controller, and a tangible, non-transitory memory configured to communicate with the controller, the tangible, non-transitory memory having instructions stored thereon that, in response to execution by the controller, cause the controller to perform operations comprising receiving, by the controller, an external command and the first catcher parameter, and controlling, by the controller, the catcher drive system in response to the first catcher parameter and the external command.

In various embodiments, the operations further comprise receiving, by the controller, the tension parameter and controlling, by the controller, the catcher drive system to maintain the tension parameter at a constant.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

Figure 1A:
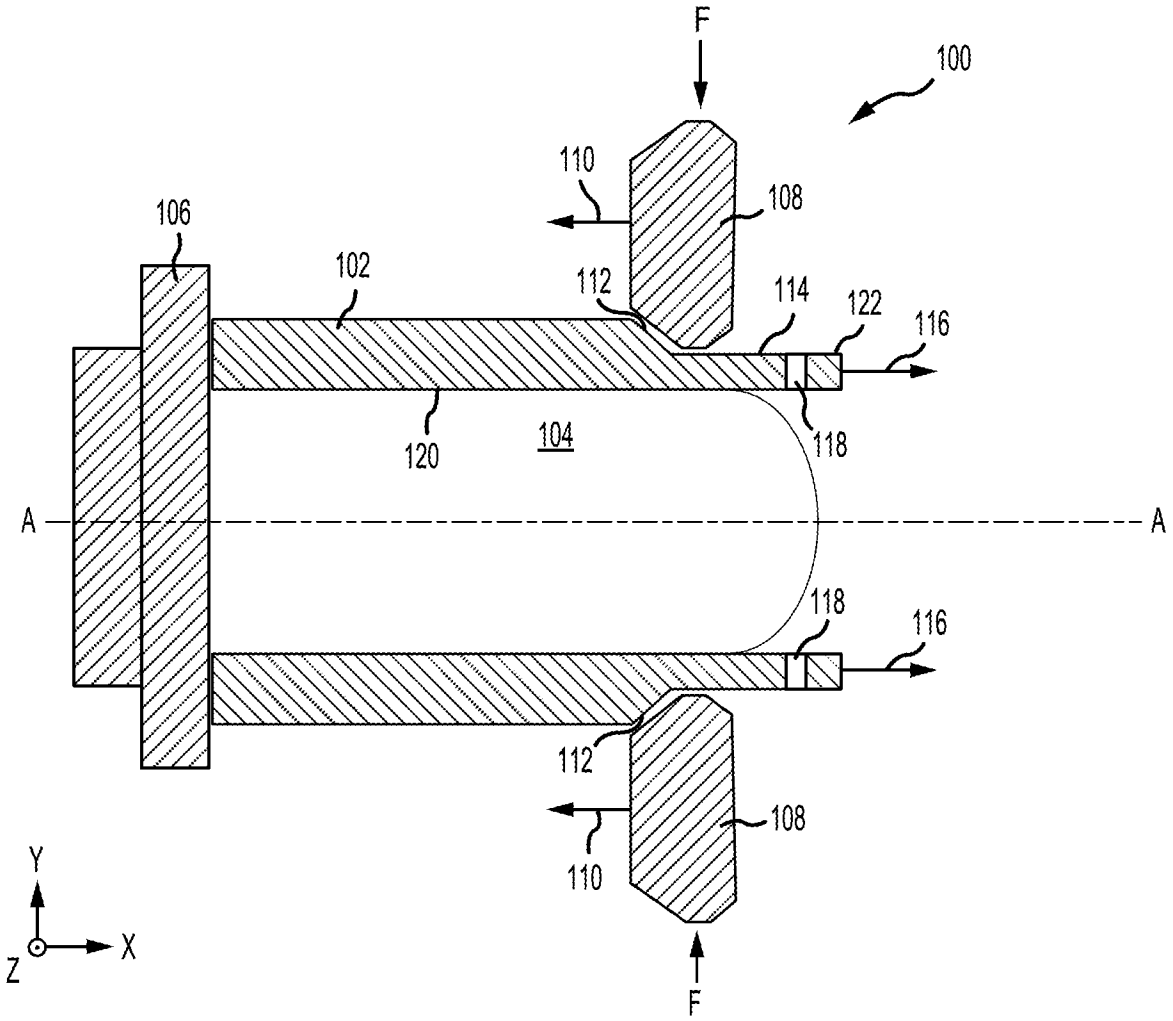
FIG. 1A illustrates an apparatus for backward flow forming, in accordance with various embodiments.

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Flow forming is a metal forming process whereby a hollow metal blank is mounted on a rotating mandrel and the metal is displaced axially along the mandrel by one or more rollers which traverse the length of the mandrel. In various embodiments, the metal blank may be a preform shape such as, for example, one of a sleeve or a cup. Flow forming may be performed either as backward flow forming or forward flow forming in accordance with the direction of axial flow during the flow forming process. In the forward flow forming technique, a blank is held between the mandrel and a tailstock while the rollers traverse from the tailstock along the mandrel tending thereby to displace material in the same direction as the traveling rollers. In various embodiments, forward flow forming tends to include a blank having a base or an internal flange or other such feature suitable for mounting in the tailstock. In the backward flow forming technique, a blank is held is held against a headstock and, as the rollers advance forward toward the headstock, the work piece is extruded backward between the roller and the mandrel.

Backward flow forming tends to be suited for blank materials having low ductility, tending thereby to allow rollers to apply high force to plasticize the blank material under the contact point. In various embodiments, the flow of material under the rollers comprises two components an axial flow component along the axis of the mandrel and a circumferential flow component. In various embodiments, backward flow forming may be prone to non-uniform dimensioning across the length of the work piece which may result from the high forces used to plasticize materials having low ductility. In various embodiments, a backward flow forming work piece may tend to sag or deform under its own weight and/or lose concentricity as the work piece travels away from the mandrel. In various embodiments, a lack of plasticity may tend to cause distortions like bell mouthing at a free end of the work piece or a preform. In various embodiments, a lack of plasticity may require a multiple-pass flow forming with or without annealing step in between. In various embodiments, a lack of plasticity in the blank material and the work piece (i.e. low ductility) may tend to increase friction against the mandrel and may tend to induce bulging and cracking of the work piece and/or the blank material.

In various embodiments and with reference to FIG. 1A, an apparatus 100 for backward flow forming is illustrated comprising a mandrel 104 and a headstock 106 at a proximate end of mandrel 104. A preform 102 is mounted on mandrel 104 and rotates with mandrel 104 about axis A-A. One or more rollers 108 apply a compressive force F to preform 102 and roll circumferentially along the surface of preform 102 in response to the rotation of mandrel 104. In various embodiments, a mandrel such as mandrel 104 may have a generally cylindrical geometry or may comprise a complex geometry having a curves, multi-radial curves, or steps and, in this regard, the circumference of a mandrel such as mandrel 104 may vary with respect to a position along axis A-A. In response to the compressive force and rolling, plastic deformation zones 112 are formed in the preform 102 between the rollers 108 and the mandrel 104. Plastic deformation zones 112 advance along the preform 102 in response to rollers 108 advancing toward headstock 106 as shown by arrows 110. As rollers 108 advance (arrows 110) a work piece 114 flows axially (along the positive x-axis) behind the rollers 108 along the surface 120 of mandrel 104 toward a distal end of mandrel 104. As rollers 108 shape preform 102 to the desired diameter, work piece 114 continues to flow along and away from mandrel 104 as shown by arrows 116. In various embodiments, coupling features 118 such as, for example, flats, a flange or holes bored through the work piece, may be formed proximate traveling end 122 of work piece 114. In various embodiments, coupling features 118 may be formed in response to traveling end 122 departing the mandrel 104. In various embodiments, a preform such as preform 102 may comprise pre-machined coupling features (i.e. coupling features machined prior to flow forming) which may be excised and discarded from the traveling end of the work piece subsequent to the backward flow forming of the preform.

Figure 1B:
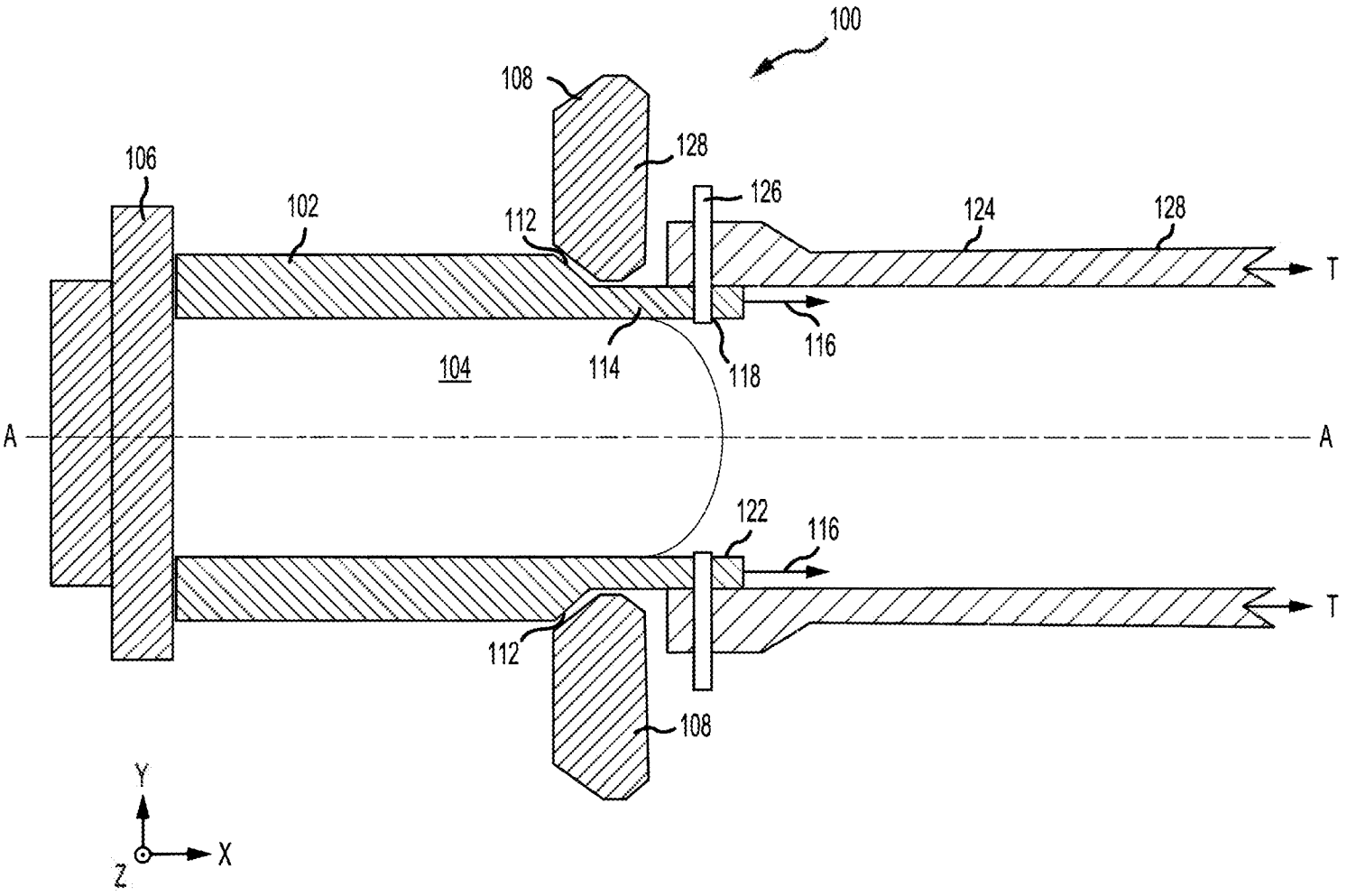
FIG. 1B illustrates an apparatus for backward flow forming, in accordance with various embodiments.
Figure 1C:
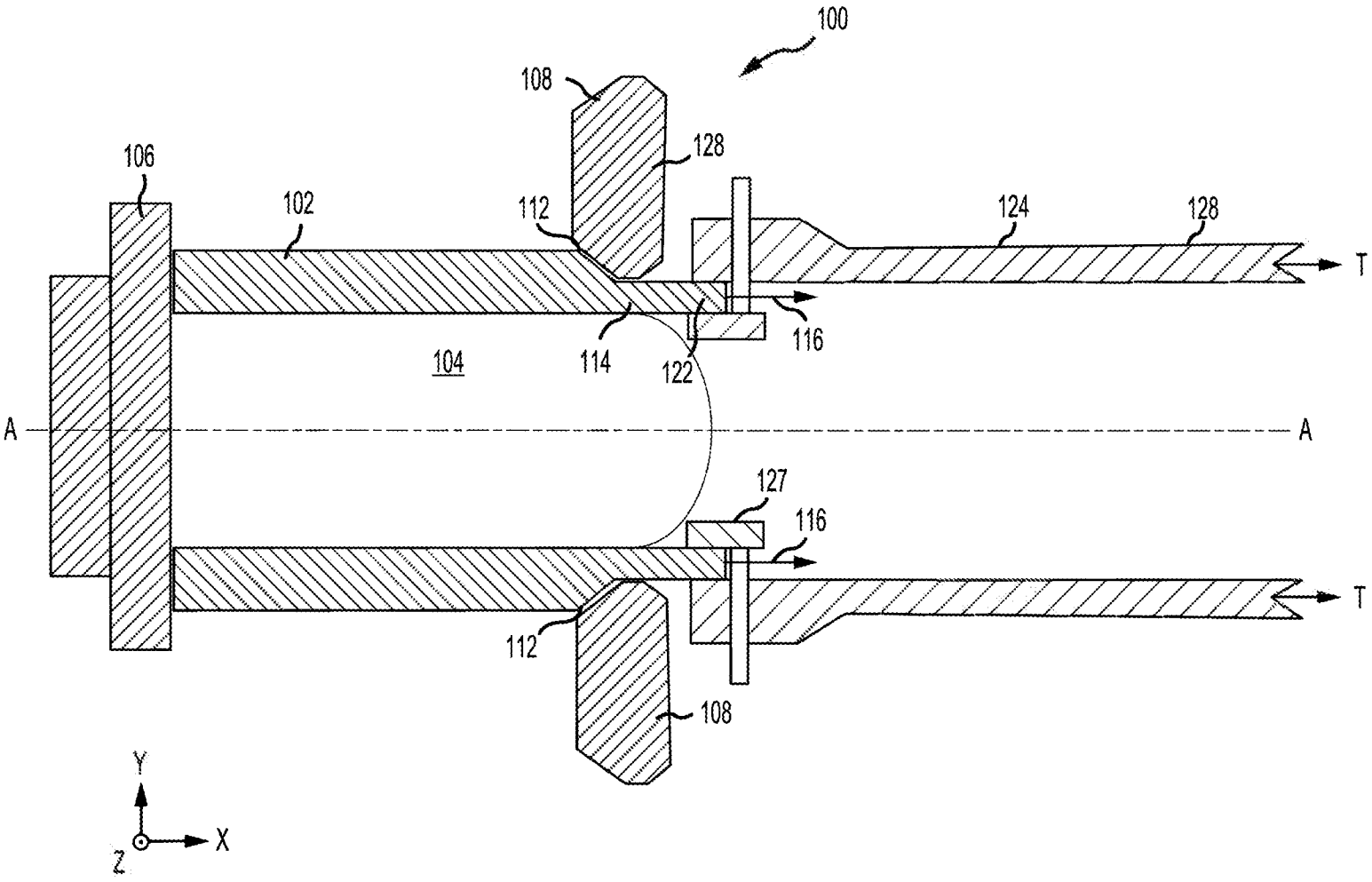
FIG. 1C illustrates an apparatus for backward flow forming, in accordance with various embodiments.
Figure 1D:
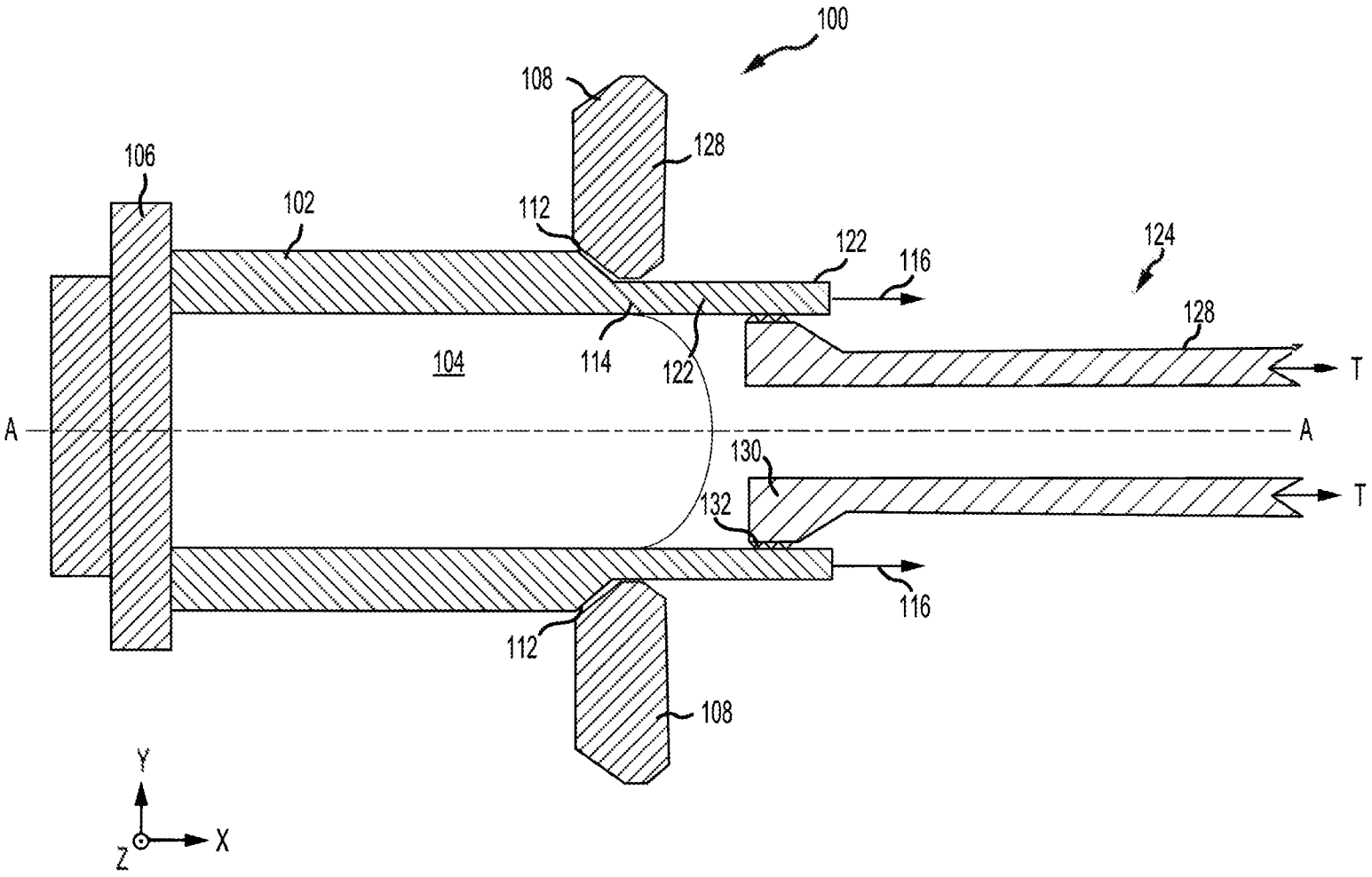
FIG. 1D illustrates an apparatus for backward flow forming, in accordance with various embodiments.

With additional reference to FIG. 1B through FIG. 1D, apparatus 100 for backward flow forming is illustrated with catcher 124 removably coupled at coupling features 118 to work piece 114 by locking pins 126. In various embodiments, catcher 124 comprise and be coupled by clamps 127 as shown in FIG. 1C, grabbers 130 having a grabbing surface 132 as shown in FIG. 1D, or other such suitable coupling mechanism. In various embodiments, clamps 127 and grabbers 130 may be mechanically, electro-mechanically, or hydraulically actuated tending thereby to apply a coupling force between clamps 127 or grabbers 130 and traveling end 122. In various embodiments, grabbing surface 132 may comprise hardened metallic grip enhancing features such as points, cones, pyramids, ridges, teeth, or other suitable feature tending to bite into the material of traveling end 122 and, in that regard, tending to enhance the coupling between catcher 124 and work piece 114. When coupled to work piece 114, catcher 124 is coaxial to mandrel 104 and rotates synchronously with work piece 114 and mandrel 104 about axis A-A. In various embodiments, catcher 124 travels (along x-axis) with flow 116 of work piece 114 and tends to support work piece 114 as traveling end 122 moves away from mandrel 104. In this regard, catcher 124 tends to reduce sag or deformation of work piece 114 under its own weight and tends to reduce loss of concentricity in work piece 114. In various embodiments, catcher 124 may apply a tension T to the work piece 114 while traveling with the flow 116 of material. In various embodiments, apparatus 100 may comprise sensors 128 which may be configured to transmit measured characteristics of apparatus 100 to a controller 202 (FIG. 2 described below), thereby providing sensor feedback about apparatus 100. In various embodiments, the measured characteristics may comprise one of a tension parameter, a deflection parameter, a catcher parameter, or an apparatus parameter. The sensor feedback may be, for example position feedback, temperature feedback, pressure feedback, shaft speed, or other data. In this regard, controller 202 may determine a tension T between the work piece 114 and the catcher 124. In various embodiments, the tension T may be a function of a total required deformation ratio and a material property of the material.

In various embodiments, catcher 124 may be configured to oscillate rotationally with respect to the rotational axis and tending thereby to cause traveling end 122 of work piece 114 to deflect relative to axis A-A. In various embodiments, work piece 114 tends to have a higher strength than the material at plastic deformation zones 112 and tends to transfer the oscillations into the plastic deformation zones 112. In this regard, the oscillation of catcher 124 may tend to trigger a plastic deformation in a localized zone of shear bands tending thereby to reduce material stresses in the plastic deformation zones and, in response, tending to improve material formability, tending to increase material microstructure homogeneity through the material thickness, and tending to reduce material susceptibility to cracking. In this regard, compressive force F at rollers 108 may tend to be reduced in proportion to the improvement in material formability tending thereby to increase an operational life of rollers 108. In various embodiments, the oscillations may be about 10° off axis A-A (i.e. a deflection as an absolute value) where the term "about" in this context means±5°. Stated another way, as work piece 114 continues to flow along and away from mandrel 104 the oscillations may tend to cause traveling end 122 of work piece 114 to trace a sinusoidal path with axis A-A defining a relative zero position of the wave form traced by traveling end 122. In various embodiments, mandrel 104 may be heated. In various embodiments, preform 102 may be pre-heated prior to backward flow forming.

Figure 2:
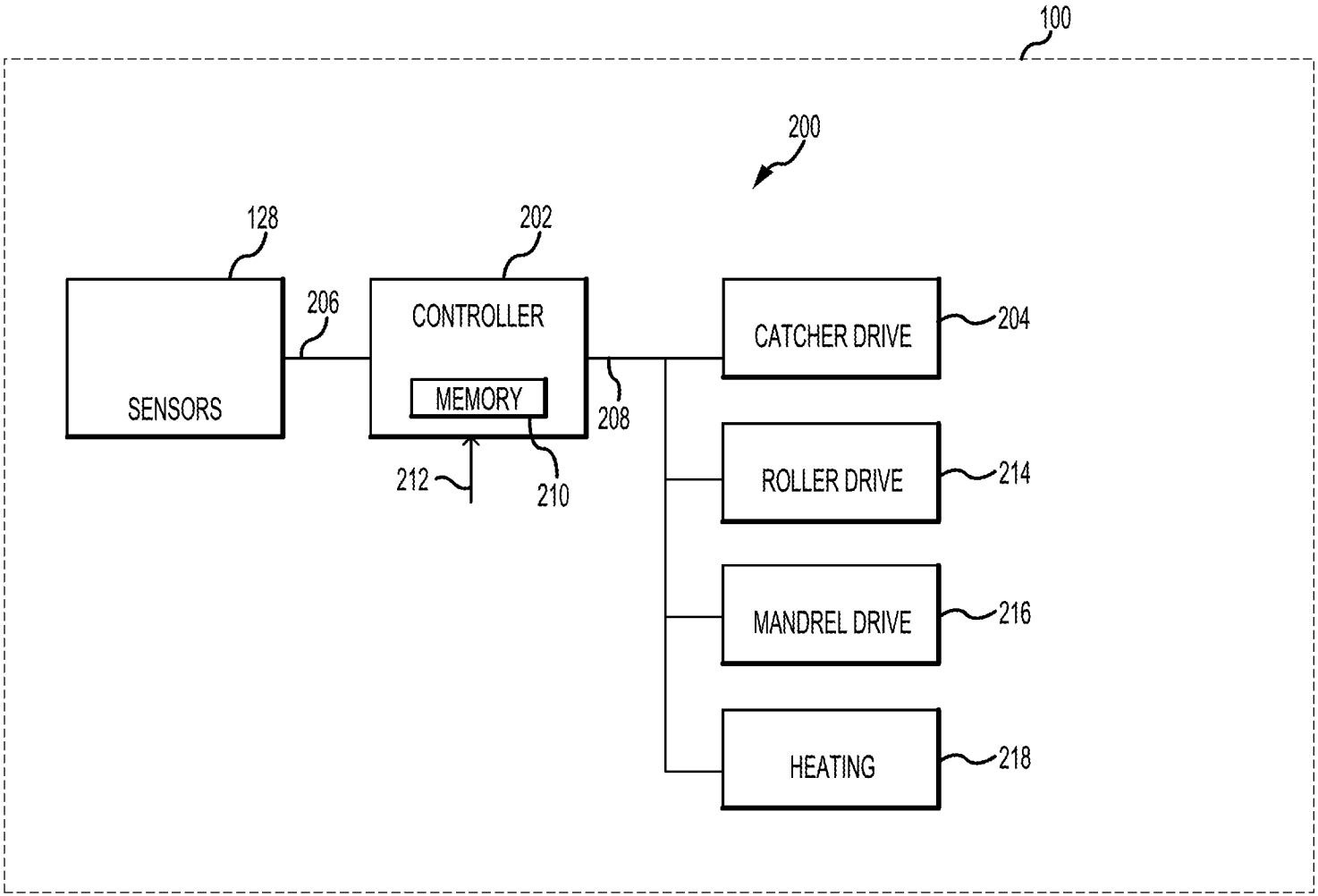
FIG. 2 illustrates a control system for backward flow forming of shafts, in accordance with various embodiments.

In various embodiments and with reference to FIG. 2, a schematic diagram of a control system 200 for backward flow forming of shafts may comprise components of apparatus 100. Control system 200 may comprise controller 202 in communication with sensors 128 and catcher drive system 204. In various embodiments, controller 202 may be in communication with roller drive system 214, mandrel drive system 216, and heating system 218. Systems in communication with controller 202 may receive commands 208 or signals from controller 202 such as to begin an oscillation, to adjust a tension, to alter an oscillation angle, to heat a component, or to alter a speed. In various embodiments, controller 202 may comprise a processor. In various embodiments, controller 202 may be implemented in a single processor or one or more processors configured to implement various logical operations in response to execution of instructions, for example, instructions stored on a non-transitory, tangible, computer-readable medium such as, for example, memory 210 which may store data used, for example, for trending and analysis/prognosis purposes. The one or more processors can be a general purpose processor, a microprocessor, a microcontroller, a digital signal processor (DSP), an application specific integrated circuit (ASIC), a field programmable gate array (FPGA) or other programmable logic device, discrete gate or transistor logic, discrete hardware components, or any combination thereof. In various embodiments, controller 202 may receive and interpret off board data 212 which may comprise configuration data, pre-recorded data, external commands, or any other data. In various embodiments, controller 202 may receive and interpret data from one or more sensors 128 located throughout apparatus 100. In various embodiments, controller 202 may receive and interpret sensor data to determine the tension T between the work piece 114 and the catcher 124 and, in response, command catcher drive system 204 to adjust a catcher position tending thereby to alter tension T. In various embodiments, controller 202 may dynamically adjust the catcher position to maintain a constant tension. In various embodiments, off board data 212 may comprise an external command of the form "start flow forming" or "stop flow forming" and controller 202 may command one of the catcher drive system 204, the roller drive system 214, or the mandrel drive system 216 in response to the external command.

Figure 3:
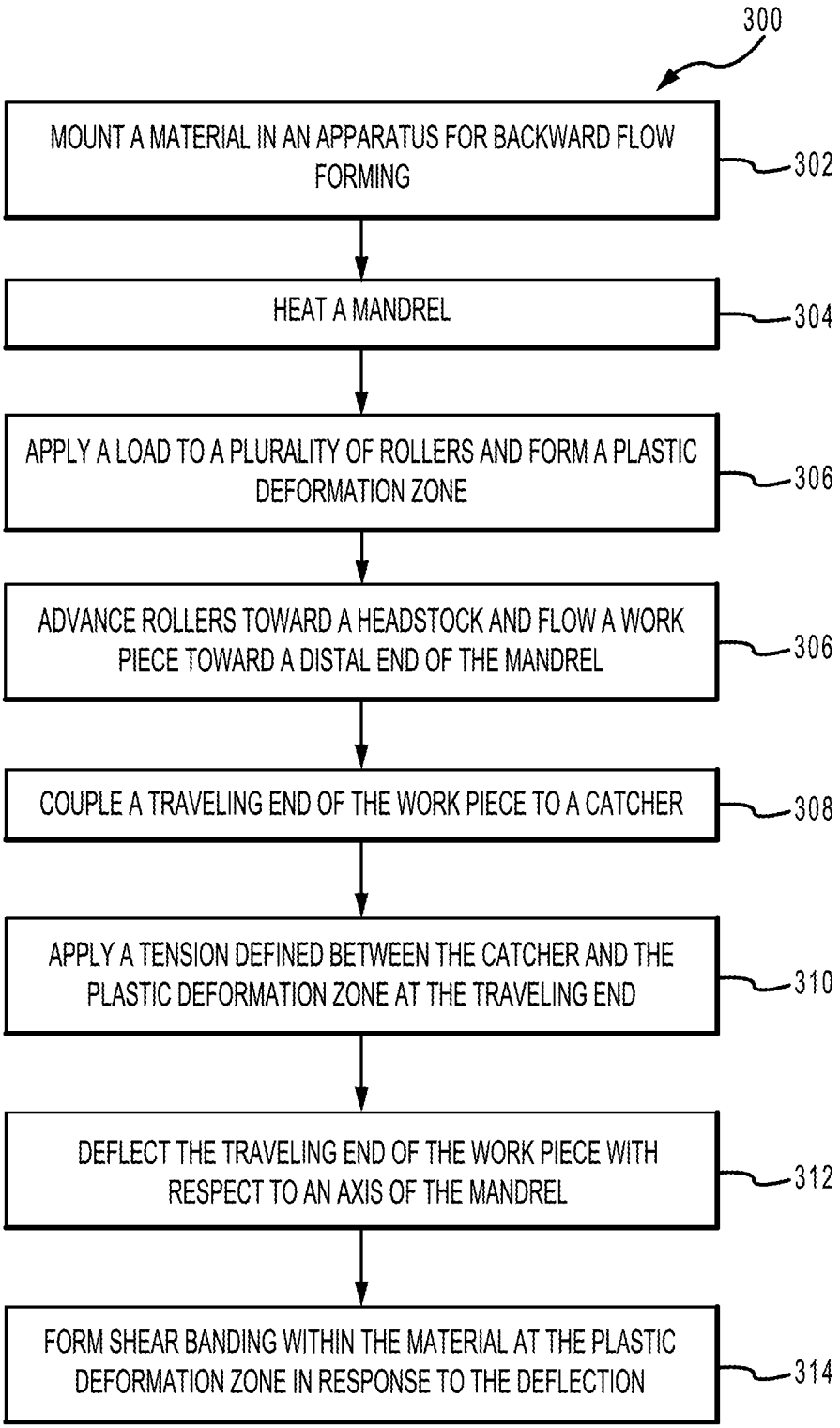
FIG. 3 illustrates method for improving backward flow forming of a material, in accordance with various embodiments.

With reference to FIG. 3, a method 300 for improving backward flow forming of a material is illustrated in accordance with various embodiments. Method 300 includes mounting the material in an apparatus for backward flow forming (step 302). In various embodiments, method 300 may include heating a mandrel (step 304). Method 300 includes applying a load to a plurality of rollers and forming a plastic deformation zone in the material between the plurality of rollers and the mandrel (step 306). Method 300 includes advancing the plurality of rollers toward a headstock at a proximate end of the mandrel (step 306), wherein a work piece flows from the plastic deformation zone between the plurality of rollers and the mandrel toward a distal end of the mandrel. Method 300 includes coupling the work piece to a catcher at a traveling end of the work piece (step 308). In various embodiments, step 308 may further comprise machining a coupling feature in the work piece proximate the traveling end of the work piece. Method 300 includes applying a tension defined between the catcher and the plastic deformation zone at the traveling end of the work piece (step 310). Method 300 includes deflecting the traveling end of the work piece with respect to an axis of the mandrel (step 312). Method 300 includes forming shear banding within the material at the plastic deformation zone in response to the deflection (step 314).

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method, comprising:

mounting a material in an apparatus for backward flow forming;

performing a backward flow forming step by operation of the apparatus, the backward flow forming step comprising:

applying a load to a plurality of rollers forming a plastic deformation zone in the material between the plurality of rollers and a mandrel, the mandrel defining a rotational axis;

advancing the plurality of rollers toward a headstock at a proximate end of the mandrel forming a work piece from the material, wherein the work piece flows from the plastic deformation zone between the plurality of rollers and the mandrel toward a distal end of the mandrel;

machining a coupling feature in the work piece proximate a traveling end of the work piece;

coupling the coupling feature of the work piece to a catcher at the traveling end of the work piece; and oscillating the catcher rotationally with respect to the rotational axis and tending thereby to cause the traveling end of the work piece to deflect relative to the rotational axis; and after the backward flow forming step, excising and discarding the coupling feature.

2. The method of claim 1, further comprising applying a tension, defined between the catcher and the plastic deformation zone, at the traveling end of the work piece.

3. The method of claim 2, wherein the coupling comprises clamping the work piece to the catcher.

4. The method of claim 2, further comprising deflecting the traveling end of the work piece with respect to an axis of the mandrel to form a deflection.

5. The method of claim 4, wherein the deflection with respect to the axis of the mandrel is 5° to 15.

6. The method of claim 4, further comprising forming shear banding within the material at the plastic deformation zone in response to forming the deflection.

* * * * *